US008393450B2

(12) United States Patent
Lynch-Ringvold

(10) Patent No.: US 8,393,450 B2
(45) Date of Patent: Mar. 12, 2013

(54) DUFFEL BAG WITH ZIPPERED PARTITIONS

(76) Inventor: Meegan Lynch-Ringvold, Marietta, NY (US)

( * ) Notice: Subject to any disclaimer, the term of this patent is extended or adjusted under 35 U.S.C. 154(b) by 476 days.

(21) Appl. No.: 12/709,777

(22) Filed: Feb. 22, 2010

(65) Prior Publication Data

US 2010/0213020 A1 Aug. 26, 2010

Related U.S. Application Data

(60) Provisional application No. 61/154,806, filed on Feb. 24, 2009.

(51) Int. Cl.
*A45C 3/00* (2006.01)

(52) U.S. Cl. ..... 190/110; 190/111; 383/38; 150/112; 150/117

(58) Field of Classification Search ..... 190/109–111, 190/20, 23, 107; 383/38; 150/112–117
See application file for complete search history.

(56) References Cited

U.S. PATENT DOCUMENTS 1,908,178 A * 5/1933 Plotkin ..... 190/109
3,768,610 A * 10/1973 Housel ..... 190/113
4,210,186 A * 7/1980 Belenson ..... 206/316.2
4,236,615 A 12/1980 Ginat
4,805,749 A * 2/1989 Gerch ..... 190/111
4,830,154 A 5/1989 Gerch et al.
4,941,603 A * 7/1990 Creamer et al. ..... 224/148.3
5,054,589 A 10/1991 Bomes et al.
5,209,328 A * 5/1993 Kotkins, Jr. ..... 190/18 A
5,427,453 A * 6/1995 Cloessner ..... 383/38
D370,560 S * 6/1996 Doerbaum ..... D3/254
6,076,485 A * 6/2000 Peeples et al. ..... 119/497
6,644,448 B2 * 11/2003 Bernbaum et al. ..... 190/111
7,416,066 B2 * 8/2008 Chernoff ..... 190/108
2002/0144916 A1 10/2002 Cheng
2002/0148741 A1 10/2002 Stobbs et al.
2003/0182872 A1 10/2003 Gresham et al.
2008/0066689 A1 3/2008 Martz

* cited by examiner

*Primary Examiner* — Tri Mai
(74) *Attorney, Agent, or Firm* — Bernhard P. Molldrem, Jr.

(57) ABSTRACT

An improved duffel bag with inner removable panels can be configured with a large main space or a central space and end spaces. The removable panels can zip up into place to divide the bag into a central space and end spaces, or can be unzipped and rolled up to create one large space or two sections. A main flap closure provides access to the central space, and end openings with zipper closures provide access to the end spaces. The bag can be available in a range of sizes and styles.

12 Claims, 3 Drawing Sheets

DUFFEL BAG WITH ZIPPERED PARTITIONS

This application claims priority of Provisional Pat. Application. Ser. No. 61/154,806, Feb. 24, 2009. The contents of that provisional application are incorporated by reference.

BACKGROUND OF THE INVENTION

This invention relates to portable carrying cases, traveling bags, or luggage, and in particular to soft-sided cases such as duffels. The invention is more particularly concerned with bags or duffel which can be internally reconfigured into main and additional compartments so that the contents can be kept separate, if desired or needed. The invention is also directed to a bag or duffel which has a main closure or flap permitting access to the central portion or main compartment of the duffel, and which has additional or auxiliary access openings that provide access to auxiliary compartments within the duffel when one or more divider panels inside the duffel are in place in the duffel.

A need has long existed for a convenient carry bag, i.e., duffel, which can be reconfigured as need be during a trip or excursion. For example, if some article of clothing becomes wet or soiled, it is often necessary to keep it apart from the dry and clean articles of clothing in the bag. Also, it may be necessary to keep purchased items separate when in the bag. At the same time, it would be to advantage to be able to access the separated articles without having to reach into the main part of the bag where the other articles are stored. There are also advantages in having the main storage compartment being as large as possible if there are no items that need to be kept separate. However, no carry bag or duffel to date has been able to fulfil these objectives.

One typical luggage case with movable partitions is described in Bomes et al. U.S. Pat. No. 5,054,589, formed of a luggage frame, zippered soft side walls, and a removable center partition. A zipper is provided so that the partition is partially removable. Another luggage case having removable compartments for storing, e.g., soiled clothing, is described in U.S. Pat. No. 4,236,615. A soft carrying case with dividers, intended as a portable carrier for cats and/or dogs, is described in Pat. Appln. Pub. No. US 2008/0066689. These prior-proposed bags and luggage are useful in understanding the background of this invention, but do not resolve the problem of how to reconfigure a duffel or similar bag in a simple and convenient fashion during the trip or excursion.

OBJECTS AND SUMMARY OF THE INVENTION

Accordingly it is an object of this invention to provide as convenient and simple to reconfigure duffel bag that can be converted from a single compartment to a main compartment and one or more additional compartments, and which avoids the drawbacks of the prior art.

It is another object to provide an improved duffel bag that can be available in a range of sizes and styles, with inner removable panel or panels, that can zip up conveniently into place to divide the bag into a central space and end spaces, or can be unzipped and rolled up to create one large space or one main space and one auxiliary end space.

A further object is to design a duffel as a waterproof, go-anywhere bag, available in small, medium, or large sizes, and available in a range of colors such as black, khaki, yellow, purple and orange, for example.

It is a further object to provide the bag with a zippered main flap for access to the central compartment, and with waterproof zippers on the bag between the central flap and the two ends, for accessing the end compartments when the bag is configured with end compartments.

In accordance with one aspect of this invention, a duffel of the type described hereinbelow has a generally elongated shell formed of a base, two end walls, two lateral sides and a top portion, and one or more carrying straps and one or more handles. A zippered flap closure at the center of the top portion provides access to the interior of the duffel. The flap closure extends to left and right positions, generally parallel to the end walls. A pair of zip-up removable and reconfigurable interior panels can be zipped into place along respective closure lines on the inside of the shell between the respective left and right extents of said zippered flap and the respective end wall. These divide the duffel interior into a central compartment and one or more end compartments. Auxiliary zippers are disposed transversely on the top of the bag between the zippered flap and the respective end walls of the duffel for access to the respective end compartment(s) formed between the zip-up interior panel(s) and the end(s) of the duffel. the divider panel(s) are formed of a flexible membrane that can be unzipped from said closure lines and rolled up, and retained against the base of the duffel, comprising straps to hold the rolled up panel(s) in place on the base.

The divider panel(s) are formed of a flexible waterproof or water resistant fabric material that can be unzipped from the closure lines on the interior of the shell, and can be rolled up and retained against the base of the duffel. One or more straps at the base can be used to hold the rolled up panel(s) in place on the base. The zippers can be of waterproof construction also, so that the panels create an effective barrier to moisture. Sewn seams can secure the bottom of the panels to the base.

In a preferred implementation, the divider panels each include a lower strip that is secured along its lower edge to the base of the duffel and is secured at its ends, by sewn seams, to the sides of the duffel adjacent the base thereof. This strip can be about one to two inches from the base to its top edge where it joins the roll-up portion of the divider panel. The divider panel has a pair of zipper members extending up each side from the lower strip to the top of the duffel. Each zipper has its own zipper pull slideable therealong its length for closing the zipper members at the top of the duffel. When unzipped, the panel is rolled up alongside the lower strip, and secured by the associated strap, e.g., a Velcro strap.

The duffel is most favorably made with durable, rugged construction of high strength nylon or other similar materials. The interior panels roll up when not used, and unroll and zip up around the interior of the bag to create the two end compartments. The end compartments can be used for storing wet or soiled clothing, for example, or for shoes or other items to be kept separate from the articles in the main or center compartment. One or both of the panels can be zipped into place depending on whether one, two or three compartments are needed.

Typical bags that embody this invention can have dimensions as follows:

- Height, Width, and Length: Small—16"×16"×25"; Medium—18"×18"×27"; Large—20"×20"×29"
- Central flap opening, zipper size: Small—14"; Medium—15"; Large—16"
- Interior Pocket Sizes: Small—5.5"×14"×5.5"; Medium—6"×15"×6"; Large—6.5"×16"×6.5" (Note: Three different interior pocket sizes, when interior pockets are in place)
- Ticket/Passport Pocket (length×height×width): Small—12"×6"×1"; Medium—14"×6"×1"; Large—16"×8"×1"

The duffel can be provided with end handles, a passport pocket on one or both sides, and dual straps that can be used as backpack straps so the duffel can be worn vertically on the user's back or carried as a duffel. While not shown in the embodiment, the duffel can optionally be provided with wheels and a pull handle.

These and many other objects, features, and advantages of the duffel of this invention will become apparent from the ensuing detailed description of a preferred embodiment, when read in conjunction with the accompanying Drawing.

DETAILED DESCRIPTION OF THE PREFERRED EMBODIMENT(S)

Figure 1:
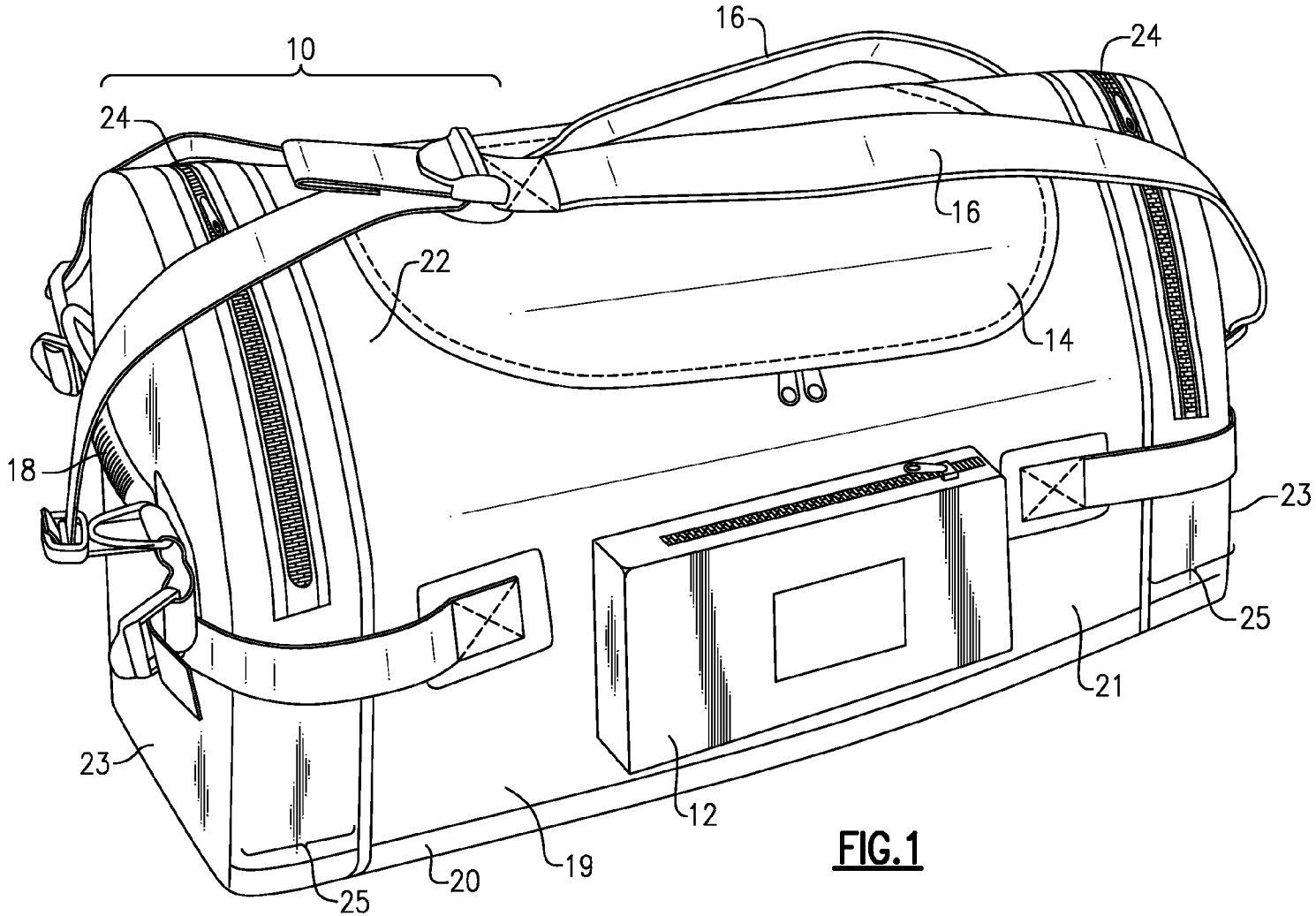
FIG. 1 is a perspective view of a duffel according to one preferred embodiment of this invention.
Figure 2A:
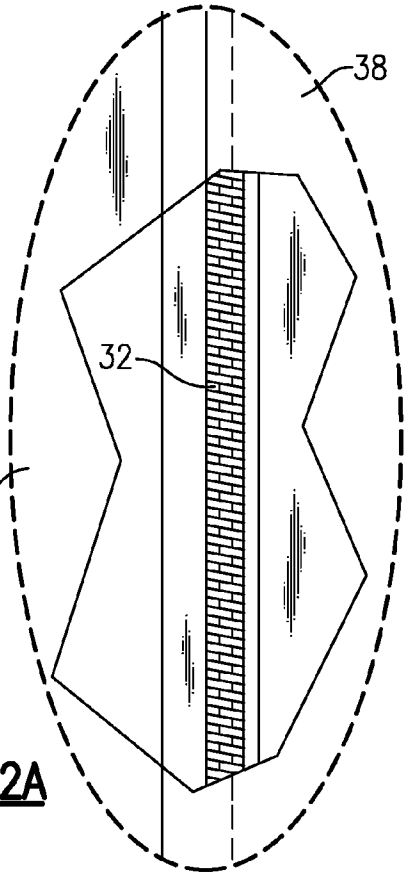
FIG. 2A is an enlarged portion of one zipper of this invention.
Figure 2:
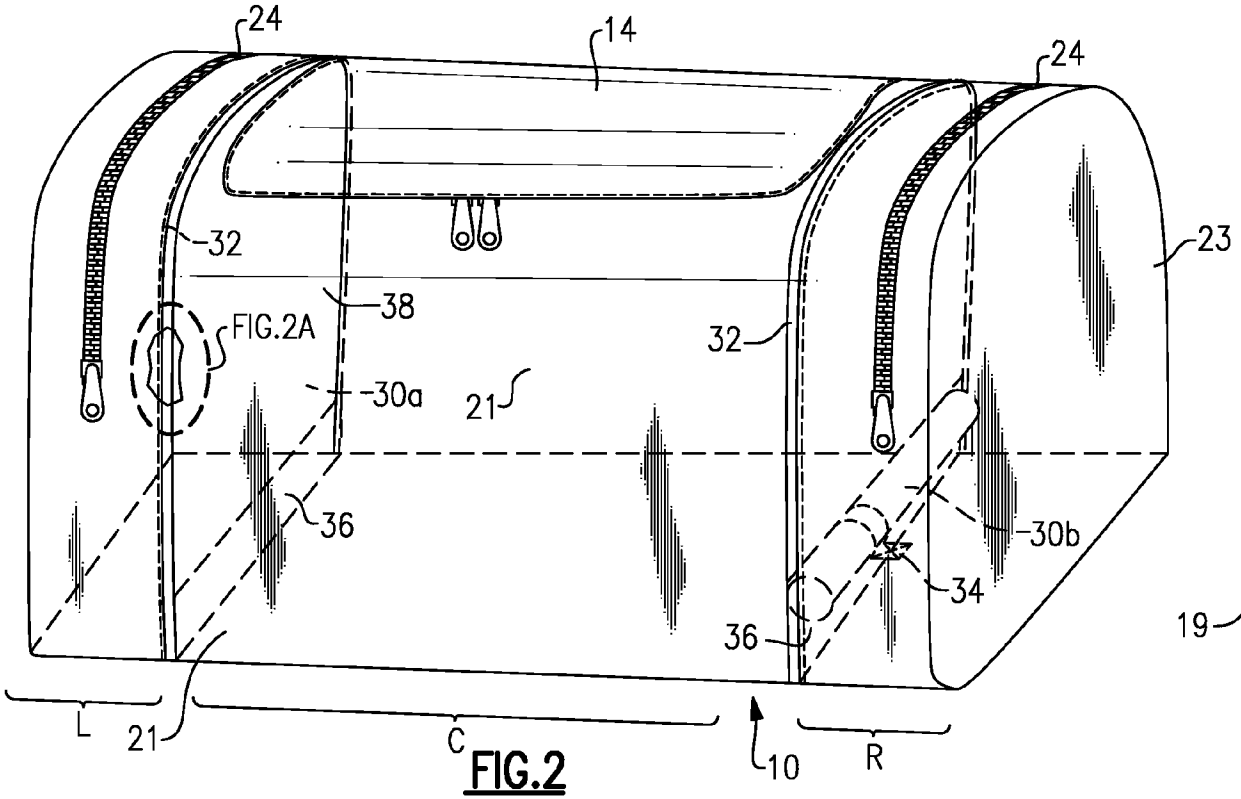
FIG. 2 is a schematic perspective, partly in broken line, showing the zip-up divider features of this embodiment.

With reference to the Drawing, FIGS. 1 and 2 show the duffel 10 as a generally cylindrical shaped article of soft luggage, with an outside zipped pocket 12 on one side (for passport and/or ticket, or other important papers) and with an ID pocket. There can be similar passport pockets 12 on both sides. On the top of the duffel 10 is a main zip-up flap 14 that opens for access to the center of the duffel. A pair of shoulder straps 16 can be used for hand-carrying the duffel, or allow the duffel to be carried vertically on the back. End handles 18 are sewn on each end. The duffel 10 has a shell or body 19 formed of a durable nylon or similar material with a base or bottom 20, sides 21, a top 22 (where the zip-up flap 14 and shoulder straps 16 are located), and ends 23. The shell can be waterproof and tear resistant.

There are waterproof zippers 24*a* and 24*b* situated to run across the top of the shell, transversely within spaces 25 that are defined between the left and right edges of the flap 14 and the two ends 23 of the duffel 10, for access to respective end compartments to be discussed shortly. These are waterproof, heavy-duty zippers. The two shoulder straps 16 may be joined by a transverse strap and held together to facilitate hand carrying.

FIGS. 2 and 2A show the interior of the duffel bag 10 in which inner zip-up compartment divider panels 30*a* and 30*b* are in place to divide the duffel interior into a center compartment C and left and right end compartments L, R. There are zippers 32 extending within the shell 19 from the duffel base, across the two side walls and top wall, that allow the panels to be attached by zipper, and to be zipped and rolled up, as shown in respect to wall divider 30*b*. When rolled up, the dividers 30*a* and 30*b* can be held down against the duffel base using Velcro strap or straps 34. The dividers 30*a*, 30*b* are unrolled and zipped up to form divider walls, or are unzipped and rolled to open the bag into a larger compartment.

The duffel can be configured with three different interior compartments at left, center and right (L, C, R) or can be configured with just one large compartment (L+C+R). Also, just one of the divider walls can be used, if desired to create two compartments.

Figure 3:
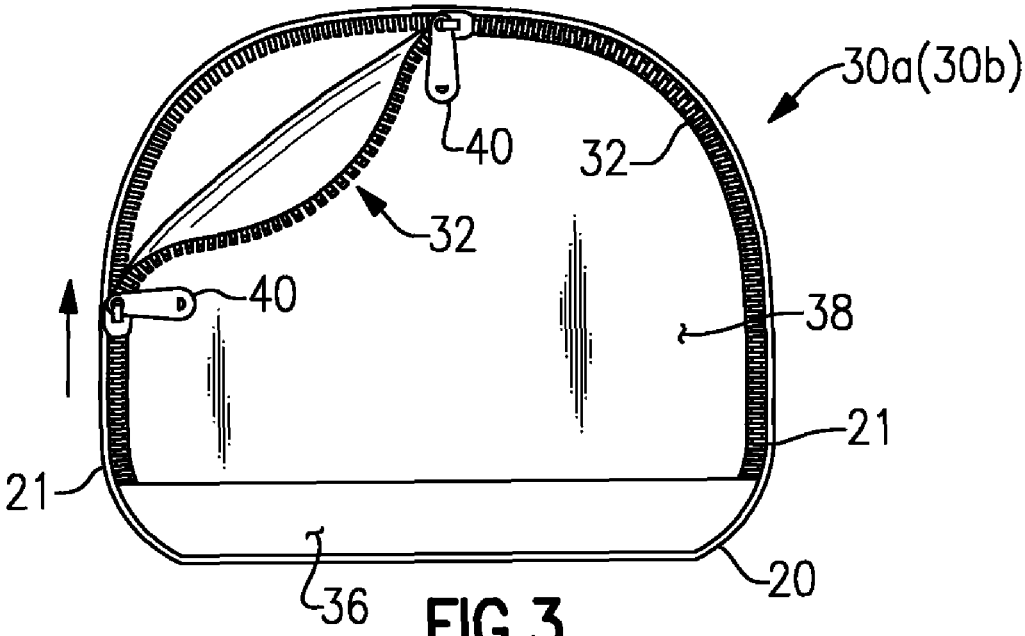
FIG. 3 is a side cut view of the bag or duffel of this embodiment showing the zip-up divider.

The zip-in/zip-out divider 30*a* or 30*b* can be constructed as generally shown in FIG. 2 and in the cut-through section of FIG. 3. The divider occupies the entire inside profile of the duffel. A lower base strip 36 is sewn in place in its base 20 and sides 21, and rises about one to two inches from the base 20, and also extends the entire width of the bag or duffel, from one side wall 21 to the other. An upper roll-up flexible portion 38 of the divider panel is sewn along its bottom edge to the base strip 36. The zippers 32 are two-end zippers, with a pair of zipper pulls or slides 40 that close the zippers in place at the top. These in effect serve as two zippers on respective opposite sides that meet at the top. Some detail of the zipper 32 is shown in FIG. 2A. In FIG. 3, the zipper 32 is shown closed together at one side, with the pull 40 at the top, and the other (left) side partly closed. The lower strip 36 is favorably made of a waterproof material, and the zippers 32 are also waterproof zippers. The zippers start at the sides of the base strip 36, rather than at the base 20, to avoid having an opening through which moisture or dirt can pass. The two zipper pulls 40 meet at the top. The upper roll-up portion 38 is preferably an impregnated or coated flexible woven material. This can be unzipped and rolled down, so as to open and join the center compartment with one or both side compartments, and the rolled-up portion 38 can be strapped in place alongside the associated base strip.

Figure 4:
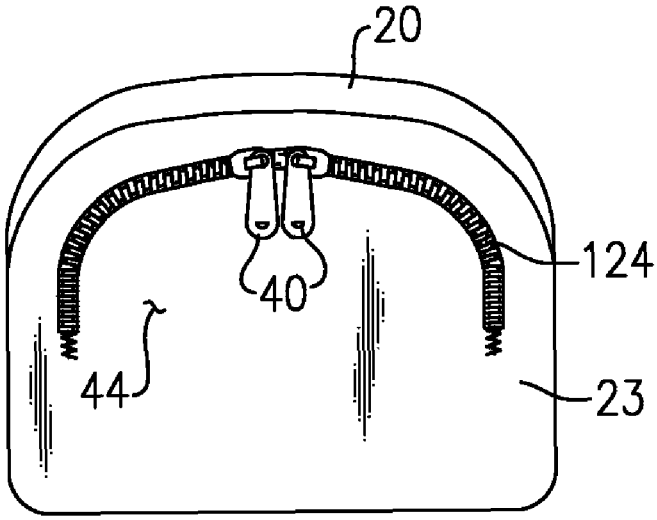
FIG. 4 is an end wall of one variant of this embodiment.

As shown in FIG. 4, as an option the access zipper 124 for one of the end compartments can be located in the end wall or panel 23, rather than across the top 22. The zipper 124 in this version defines an access flap 44 in the end wall, for accessing the associated end compartment. Other alternative equivalent arrangements are possible.

The duffel 10 can be created in different shapes and styles, and there can be more than the two divider panels 30*a* and 30*b*, if more reconfigurable compartments are needed, depending on the bag designer and the perceived needs of the users. In some cases, only a single removable panel 30*a* may be used, e.g., for a very small bag. While not depicted here, the duffel may be provided with wheels or rollers and a pull handle.

The invention is not limited to the foregoing embodiments, and many modifications and variations are possible without departing from the main concept. Rather the scope of this invention is defined in the appended claims.

I claim:

1. A duffel which comprises a shell that has a base, end walls, sides and a top portion, one or more carrying straps and one or more handles, a zippered flap closure at the center of the top portion for accessing the interior of the duffel, the flap closure extending laterally to left and right edge portions of the flap closure; a pair of zip up reconfigurable interior panels that can be zipped into place along respective closure lines on the inside of said shell at positions that are between the respective left and right extents of said zippered flap and the respective end walls to divide the duffel interior into a central compartment and one or more end compartments, and capable of being detached from the sides and top portion of said duffel and rolled up to create a combined compartment from said central compartment plus one or both end compartments; and a pair of transverse zippers disposed transversely on the bag beyond the edges of the zippered flap to permit access to the respective end compartment that is formed between the zip-up interior panel and the associated end wall of the duffel; wherein the interior panels each include an upper portion and a lower strip, the upper portion being formed of a tough flexible membrane that can be unzipped from the sides and top portion of the shell and rolled up and retained against the base of the duffel, and said lower strip extending transversely across said duffel and having a predetermined width, a lower edge, an upper edge, and two ends, with said lower edge being affixed to the base of the duffel and said ends being affixed to corresponding bottom portions of the sides of said shell adjacent said base, and the upper portion divider being sewn along its lower edge to the upper edge of said lower strip; such that when unzipped and rolled down to open and join the center compartment to the respective end compartment, the rolled up interior panel upper portion can be strapped in place alongside the associated lower strip at the base of the duffel.

2. The duffel of claim 1 wherein the lower strips of the interior panels are formed of a water-resistant material, the duffel also comprising straps to hold the rolled up panel upper portion in place alongside the associated lower strip on the base.

3. The duffel of claim 2 wherein the lower strips of said interior panels are secured by sewn seams to said base.

4. The duffel of claim 2 wherein the flexible membranes of the upper portions of said interior panels are formed of a water-resistant material.

5. The duffel of claim 2 wherein each said lower strip is secured on a lower edge to the base of the duffel and is secured at ends thereof by a sewn seam to the sides of the duffel adjacent the base thereof.

6. The duffel of claim 1 each said interior panel having a pair of zipper members extending along an edge of the upper portion thereof starting from said lower strip to the top of the duffel and each having a respective zipper pull slideable therealong for closing the zipper member at the top of the duffel.

7. A duffel which comprises a shell that has a base, end walls, sides and a top portion, one or more carrying straps and one or more handles, a zippered flap at the center of the top portion for accessing the interior of the duffel; and a zip-up and reconfigurable interior panel that can be zipped into place on a respective closure line on the inside of said shell between positions of said zippered flap and a respective end wall to divide the duffel interior into a central compartment and an end compartment, and capable of being unzipped and detached from the sides and top portion of said duffel and rolled up to create a combined compartment from said central compartment plus said end compartment; and a transverse zipper closure disposed transversely on the top of the bag beyond the zippered flap of the duffel to permit access to the respective end compartment formed between the zip-up interior panel and the end wall of the duffel; wherein the interior panel includes an upper portion and a lower strip, the upper portion being formed of a tough flexible membrane that can be unzipped from the sides and top portion of the shell and rolled up and retained against the base of the duffel, and said lower strip extending transversely across said duffel and having a predetermined width, a lower edge, an upper edge, and two ends, with said lower edge being affixed to the base of the duffel and said ends being affixed to corresponding bottom portions of the sides of said shell adjacent said base, and the upper portion being sewn along its lower edge to the upper edge of said lower strip; such that when unzipped and rolled down to open and join the center compartment to the respective end compartment, the rolled up interior panel upper portion can be strapped in place alongside the associated lower strip at the base of the duffel.

8. The duffel of claim 7 comprising one or more straps to hold the rolled-up upper portion of the interior panel in place on the base alongside the associated lower strip when the panel upper portion is unzipped and rolled up.

9. The duffel of claim 7 wherein the lower strip of said interior panel is secured by a sewn seam to said base.

10. The duffel of claim 7 wherein said interior panel lower strip is secured on a lower edge to the base of the duffel and is secured at ends thereof by a sewn seam to the sides of the duffel adjacent the base thereof.

11. The duffel of claim 10 in which said lower strip upper edge is between one inch and two inches above the base of the duffel.

12. The duffel of claim 7, said interior panel having a pair of zipper members extending from said lower strip to meet at the top of the duffel and each having a respective zipper pull slideable therealong for closing the zipper member at the top of the duffel.

* * * * *